United States Patent [19]

Rexroad

[11] 4,089,632

[45] May 16, 1978

[54] FUEL CONTROL SAFETY APPARATUS

[76] Inventor: Basil E. Rexroad, Rte. #1 - Box 383 A, Palisade, Colo. 81526

[21] Appl. No.: 719,424

[22] Filed: Sep. 1, 1976

[51] Int. Cl.[2] ..... F23N 5/10

[52] U.S. Cl. ..... 431/21; 337/405; 136/242

[58] Field of Search ..... 431/21; 337/404, 405; 136/231, 242

[56] References Cited

U.S. PATENT DOCUMENTS

| | | | |
|---|---|---|---|
| 3,652,195 | 3/1972 | McIntosh | 431/21 |
| 3,960,604 | 6/1976 | Heitzinger | 136/232 |

FOREIGN PATENT DOCUMENTS

| | | | |
|---|---|---|---|
| 685,917 | 1/1953 | United Kingdom | 431/21 |

*Primary Examiner*—Carroll B. Dority, Jr.
*Attorney, Agent, or Firm*—Max L. Wymore

[57] ABSTRACT

A thermocouple is connected to a fuel control valve which automatically feeds fuel to the burner of a gas or oil appliance when activated by a current generated by the thermocouple due to heat produced by the burner. A fusible link safety device having an electrically non-conducting base and containing a fusible filament adapted to melt at a predetermined temperature is located above and in front of the burner. The fusible link safety device is electrically connected in series with the thermocouple and the fuel control valve such that when the predetermined temperature of the fusible filament is attained thereby melting the filament, the electrical circuit from the thermocouple to the fuel control valve is broken thereby deactivating the fuel control valve and shutting off the flow of fuel to the burner.

7 Claims, 4 Drawing Figures

FUEL CONTROL SAFETY APPARATUS

BACKGROUND OF THE INVENTION

1. Field of the Invention

This invention relates to heat-responsive controls for gas or oil burning appliances and more particularly to fuel flow control devices for burners in hot water heaters, furnaces, boilers, stoves and the like. Specifically, this invention relates to a fuel flow safety control device for preventing continued overfiring of the burner.

2. Description of the Prior Art

A variety of fuel control devices have been utilized for years to control the flow of fuel such as gas or oil to the burners of various appliances such as hot water heaters, furnaces, boilers, stoves, and the like. In addition, temperature sensing safety devices have frequently been utilized in conjunction with such fuel control devices to prevent overheating of the appliance or detect pilot light failures.

Thermocouples are frequently utilized as temerature sensors in fuel control systems inasmuch as they generate thermoelectric currents at specified temperatures. One common use of thermocouples is to sense the pilot flame for a burner. In such a system, the electrical current generated by the thermocouple due to heat produced by the pilot flame will maintain the fuel control valve in an active state thereby allowing fuel to flow to the burner. If, however, the pilot flame is extinguished for any reason, the thermocouple will cease generating electricity thereby deactivating the fuel control valve and thus stopping the flow of fuel to the burner. In addition, it has been found desirable to connect various safety switches or devices in series with the thermocouple which are responsive to conditions within the appliance other than pilot flame failures, such as overheating of the appliance of overfiring by the burner.

U.S. Pat. No. 1,910,944, issued to F. D. Austin, is directed to a safety control apparatus of the above type which includes a thermally responsive circuit closure for the power circuit of an automatic fuel feed, and means for enabling the circuit closer to be subjected to internal boiler temperature while safeguarde from other internal boiler parameters. Also disclosed is a structure for preventng short circuiting of the power current incident to response of the circuit closure to excessive temerature. In particular, this patent provides for a fusible link positioned within a hot water boiler and connected in series with one of the power lines to the blower motor of the boiler. When a temperature develops within the boiler in excess of that normally tolerable, the fusible link will separate thereby shutting off power to the blower motor.

U.S. Pat. No. 2,788,417, issued to Fichter, is directed to heat-responsive controls for a fuel feeder to the burner of a furance. Associated therewith are means for breaking the feed under certain conditions, such as a gas control valve and a pilot light thermostat. These controls are shown to be connected in series as part of the electrical circuit leading from the power line and are intended to break the circuit through actuation of any one of the controls. The patent also teaches that when foreign matter collects at the electrical contacts of the thermostat, or when one of the movable elements has been distorted accidently or from tampering by inexperienced persons, the circuit is not broken when certain predetermined operating conditions have been reached and therefore will continue to operate and feed fuel to the burner. To prevent this from occurring, the patent also provides for a separate unit, having a fusible element, to be installed in any part of the mechanism. When the temperature at that location exceeds a predetermined limit, the fusible element will melt therby directly shutting off the power to the fuel control valve.

U.S. Pat. No. 3,924,099, issued to Housel, is directed to a forced circulation electric heater which includes a thermal fuse located between electrical heating coils and the fans and serves to deenergize the heating coils should excessive heat build-up occur in the housing. A thermal fuse block is illustrated in this patent to support a fusible element.

U.S. Pat. No. 3,652,195, issued to McIntosh et al, teaches a thermocouple control system which includes a thermocouple, an operator for a fuel control device, and a fusible link assembly connected in series with the thermocouple and the operator. The fusible link assembly, normally in a closed state, assumes an open state upon sensing a predetermined temperature. This deenergizes the operator by creating an open circuit, thereby shutting off the fuel flow to the burner. Specifically disclosed is a fusible link assembly located to the left and below the main burner of a furnace and connected in series with a thermocouple for pilot flame detection and an operator for a fuel control device such that if a sufficient temperature is built up in the lower part of the furnaces' combustion chamber sufficient to melt the fusible link, as caused by a reverse flow of air through the furnace flue, the safety valve in the fuel control device closes thereby breaking the fuel feed. However, the system disclosed in this particular patent requires the use of a very special fusible link assembly as well as a thermocouple adapted to sense a pilot flame. Thus, this device has the disadvantage of being relatively expensive and complex.

SUMMARY OF THE INVENTION

The present invention provides a simple and economical safety control apparatus for preventing overheating by or overfiring of burners in gas and oil burning appliances. Such overfiring is usually caused by unfavorable or improper positioning or functioning of fuel control valves. Continued overfiring can result in carbon build-up on internal passages of the fuel line and burner which may eventually result in burner flames being forced to roll out from beneath the normal passage and/or flue areas. This situation can burn and melt the poorly located control valves causing considerable damage to the appliance and possibly to personnel operating the apliance.

It is, therefore, a primary object of the present invention to provide heat-responsive controls for use in regulating the flow of fuel to the burner of a gas or oil burning appliance.

It is another object of the present invention to provide a fuel control safety apparatus designed to shut off fuel flow to the burner of a gas or oil burning appliance when overheating by or overfiring of the burner occurs.

It is a further object of the present invention to provide an easily mounted and simply constructed fusible link assembly connected in series with a thermocouple and a fuel control valve in a gas or oil burning appliance to prevent overheating by or overfiring of the appliance's burner. In accordance with the invention, a fuel control device for controlling the flow of fuel to the burner of a gas or oil burning appliance is electrically connected in series with a thermocouple and a fusible link safety device. The thermocouple is preferably physically secured to the fuel control device, although it is not directly grounded thereto as is normally the case. The fuel control device, preferably a fuel control valve, is designed to feed fuel to the appliance burner only when it is activated by a current generated by the thermocouple due to heat produced by the burner. If the current from the thermocouple ceases for any reason, the fuel control device is deactivated thereby stopping the flow of fuel to the appliance burner.

The fusible link safety device includes a fusible filament secured to a non-conducting base, the fusible filament being designed to melt at a predetermined temperature. One end of th fusible filament is electrically connected to the exterior of the thermocouple, while the other end of the fusible filament is electrically grounded to the fuel control device thereby providing a complete cirucit. The fusible link safety device is located directly above and in front of the appliance burner so that if overheating or overfiring occurs and the predetermined temperature is attaned, the fusible filament will melt thus breaking the ground connection to the fuel control device. This causes the electric current from the thermocouple to the fuel control device to cease, thereby deactivating the fuel control device and stopping the flow of fuel to the burner.

DESCRIPTION OF THE PREFERRED EMBODIMENT

Figure 1:
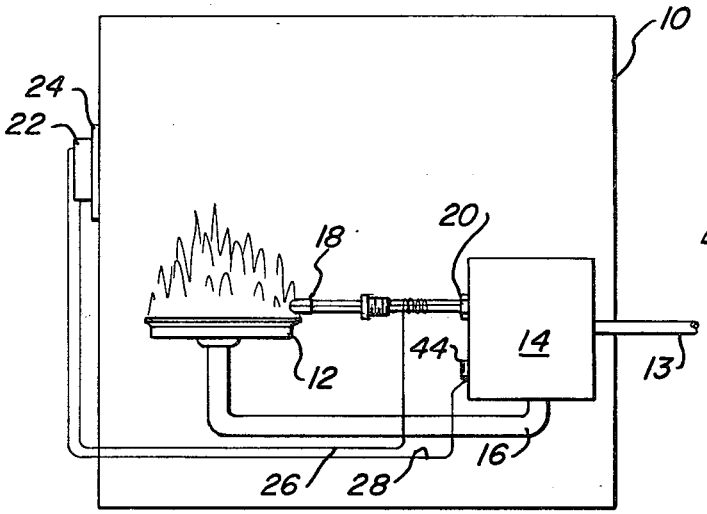
FIG. 1 is a schematic view of a gas or oil burning appliance with a fuel control safety device according to the present invention.

Referring to FIG. 1, a gas or oil burning appliance 10, such as a hot water heater, furnace, boiler, stove, or the like, contains a burner box 12. A fuel control device 14, preferably a fuel control valve, supplies and regualtes the flow of fuel to burner box 12 through fuel line 16 via line 13. Fuel control device 14 may also be a regulator or electrical relay for a fuel control valve. A thermocouple 18 is provided for generating an electrical current to the fuel control device 14 in response to heat from the flame present within burner box 12. As illustrated, the thermocouple 18 is preferably physically connected to fuel control device 14, although it may be positioned elsewhere. As seen in greater detail below, an electrically non-conducting bolt connection means 20 surrounds thermocouple 18 and secures it to fuel control device 14 in such a manner as to prevent direct ground of thermocouple 18 to device 14.

Located above and in front of burner box 12 is a fusible link safety assembly 22. The fusible link safety assembly 22 includes an electrically non-conducting base 24 which may be secured to any metal jacketing present in the appliance at the proper location. Fusible link safety assembly 22 is electrically connected to the exterior of thermocouple 18 by a first conductor 26, and is electrically grounded to fuel control device 14 by a second conductor 28.

Figure 2:
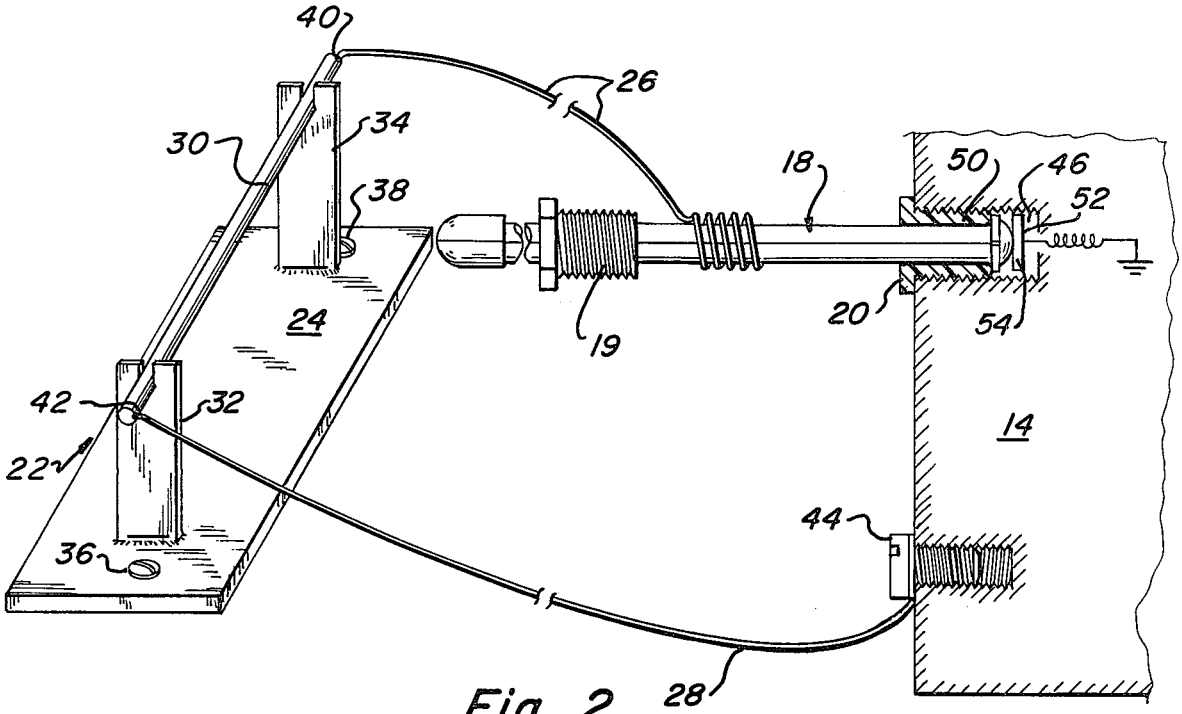
FIG. 2 is a schematic view of the fuel control safety device of the present invention with parts in perspective and parts in section.

Turning now to FIG. 2 where the preferred embodiment is illustrated in greater detail, it should be noted that the same numerals are utilized for like parts in all the figures. In FIG. 2, the fusible link safety device 22 includes a fusible filament 20 which is preferably a low melting metal made of lead or aluminum. Fusible filament 30 is designed to melt at a certain predetermined temperature, that temperature depending upon the particular requirements of the appliance wherein the present invention is utilized. Fusible filament 30 is secured to an electrically non-conducting base 24 by brackets 32 and 34, although any means for securing filament 30 to base 24 may be utilized. Base 24 is constructed from an electrically non-conducting material in order to prevent element 30 from being grounded to the surface on to which base 24 is secured. Preferably, base 24 is made from a semi-rigid plastic or celluloid so that it will also destruct whenever overfiring of the appliance burner occurs. Base 24 may be secured to a surface through the use of screws 36 and 38, or it may simply be attached with a contact-type cement material.

One end 40 of fusible filament 30 is connected by a first conductor 26 to the exterior surface of thermocouple 18, while the other end 42 of fusible filament 30 is grounded by a second conductor 28 to any screw or bolt 44 connected to fuel control device 14. This provides a complete circuit from thermocouple 18 to fuel control device 14 via fusible filament 30.

As previously mentioned, thermocouple 18 of conventional design is preferably physically connected to fuel control device 14. A split, non-conducting nut connection means 20 secures thermocouple 18 in place to device 14 while preventing the exterior of thermocouple 18 from being grounded thereto. This non-conducting nut connection means 20 replaces the normally utilized metal nut connecting means for securing thermocouple 18 within orifice 46 in fuel control device 14.

Figure 3:
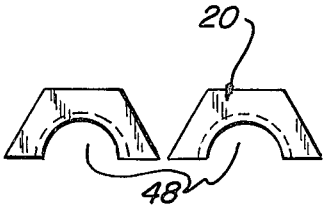
FIG. 3 is a top plan view of a split, non-conducting bolt connection means in an open position utilized for securing the thermocouple to the fuel control device in the present invention.
Figure 4:
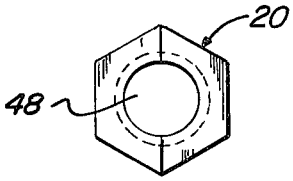
FIG. 4 is a top plan view similar to FIG. 3 but with the bolt connection means in a closed position.

The electrically non-conducting split-nut connection means 20 is more clearly illustrated in FIGS. 3 and 4 wherein nut connection means 20 is shown in separated position in FIG. 3 and in a joined position in FIG. 4. An orifice 48 extends through the center of bolt means 20 so that bolt means 20 may surround the thermocouple 18 and then be pushed into position within orifice 46, there being serrations along the exterior of portion 50 of nut connection means 20 in order to maintain connection means 20 and thermocouple 18 in place. The split-nut arrangement provides for insulating the exterior of the thermocouple from the device 14 and avoids the necessity of removing the metal nut 19 normally found as an integral part of the thermocouple arrangement. Further metal nut may provide a means to connect the conductor 26 to the thermocouple body in suitable fashion.

Referring back to FIG. 2, the bottom portion 52 of thermocouple 18 is in direct electrical contact with contact point 54 of the thermo generator arming circuit 56. This completes the circuit to fuel control device 14 so that the present invention can break the fuel feed to the appliance burner in the case of overheating by or overfiring of the burner.

In operation, the thermocouple 18 normally generates a constant electric current due to the heat produced by the burner box 12. This electrical current activates the fuel control device 14 so that device 14 automatically feeds fuel to the burner box 12 via lines 13 and 16. If thermocouple 18 ceases to generate and provide electrical current to device 14, the fuel control device 14 is deactivated, and the flow of fuel to burner box 12 is stopped. Specifically, if fuel control device 14 is a fuel control valve, the current from thermocouple 18 maintains the valve in an open position to enable fuel to flow to the burner. If this current ceases, the valve closes to shut off the fuel flow.

In the illustrated apparatus, the current from thermocouple 18 passes through fusible filament 30 prior to ground on fuel control device 14, thereby making filament 30 an intricate part of the thermocouple circuit. If the burner box overfires and thereby produces a short but very hot blast of heat to where the predetermined temperature of fusible filament 30 is reached, or if the appliance overheats to the same extent, fusible element 30 will melt thereby breaking the ground connection from thermocouple 18 to fuel control device 14. This break in the circuit stops the generation of electric current by the thermocouple thereby deactivating the fuel control device and stopping the flow of fuel to burner box 12 so as to prevent continued overfiring or overheating. It should be noted that thermocouple 18 as used in conjunction with the present embodiment actually functions opposite from that of its usual function of stopping fuel flow when there is no heat within the appliance to generate an electric current within thermocouple 18.

As previously mentioned, most burner overfirings result from unfavorable or improperly positioned or functioning fuel control devices, and continued overfiring can have very serious and damaging consequences. While prior are fuel control safety devices may prevent general overheating of the appliance, they are not directed to preventing intermittent overfiring of the burner. Thus, the present invention not only prevents both overheating and overfiring, but it also indicates by such prevention, since the fusible link safety device must be replaced in order to utilize the appliance again, that there is something malfunctioning or improperly positioned in the fuel train of the appliance, usually the fuel control valve.

From the above, it will be seen that the present invention provides a fuel control safety apparatus for gas or oil burning appliances which is very low in cost, easily mounted, simply constructed, and completely reliable if properly mounted. In addition, the present invention may be readily utilized with any fuel control device or regulator for such device within the gas or oil appliance.

It will be understood that the invention may be embodied in other specific forms without departing from the spirit or central characteristics thereof. The present examples and embodiments, therefore, are to be considered in all respects as illustrative and not restrictive, and that the invention is not to be limited to the details given herein but may be modified within the scope of the appended claims.

What is claimed is:

1. A fuel control safety apparatus for preventing continued overfiring of a burner means comprising:

thermocouple means adapted to generate an electrical current in response to temperature;

fuel control means adapted to automatically feed fuel to said burner means when activated by the current from said thermocouple means;

fusible link safety means having a fusible filament adapted to melt at a predetermined temperature, said fusible link safety means being disposed above and in front of said burner means; and, circuit means connecting the fusible filament of said fusible link safety means in series with said thermocouple means and said fuel control means such that when said predetermined temperature is attained and said fusible filament melts, the electrical current from said thermocouple means to said fuel control means ceases thereby deactivating said fuel control means and stopping the flow of fuel to said burner means;

wherein said thermocouple means is physically connected to said fuel control means by a threaded electrical insulating means surrounding said thermocouple to prevent direct grounding of said thermocouple means to said fuel control means.

2. A fuel control safety apparatus for preventing continued overfiring of a burner means comprising:

thermocouple means adapted to generate an electrical current in response to temperture;

fuel control means adapted to automatically feed fuel to said burner means when activated by the current from said thermocouple means;

fusible link safety means having a fusible filament adapted to melt at a predetermined temperature, said fusible link safety means being disposed above and in front of said burner means; and, circuit means connecting the fusible filament of said fusible link safety means in series with said thermocouple means and said fuel conrol means such that when said predetermined temperature is attained and said fusible filament melts, the electrical current from said thermocouple means to said fuel control means ceases during thereby deactivating said fuel control means and stopping the flow of fuel to said burner means;

wherein said thermocouple means is physically connected to said fuel control means in a manner to prevent direct grounding of said thermocouple means to said fuel control means;

wherein a plastic bolt connection means secures and prevents the grounding of said thermocouple means to said fuel control means.

3. The apparatus according to claim 2, wherein said fuel control means comprises a fuel control valve for automatically regulating the flow of fuel to said burner means.

4. The apparatus according to claim 2 wherein said fuel control means comprises an electrical relay to a fuel control valve for automatically regulating the flow of fuel to said burner means.

5. The apparatus according to claim 2 wherein said fusible link safety means comprises a low melting metal filament adapted to melt at a predetermined temperature and secured to a plastic base, said filament being connected directly to said circuit means.

6. The apparatus according to claim 2 wherein said circuit means comprises first and second conductors, said first conductor being connected to the exterior of said thermocouple means and to one end of said fusible filament, and said second conductor being connected to the second end of said fusible filament and grounded to said fuel control means.

7. A fuel control safety link device for an appliance having a burner, a thermocouple adapted to generate an electrical current in response to temperature, and a fuel control valve for automatically feeding fuel to the burner when activated by the current from said thermocouple, said fuel control safety link device comprising a fusible link safety means having a fusible filament adapted to melt at a predetermined temperature and disposed in front of and above said burner, a threaded electrical insulating means surrounding and mounting said thermocouple means on said fuel control valve for preventing grounding of said thermocouple to said fuel control valve, and circuit means connecting said fusible filament in series with said thermocouple and said fuel control valve such that when said predetermined temperature is attained and said filament melts, the electrical current from said thermocouple ceases thereby deactivating said fuel control valve and stopping the flow of fuel to said burner.

* * * * *